US009668590B1

(12) United States Patent
Bruegmann

(10) Patent No.: US 9,668,590 B1
(45) Date of Patent: Jun. 6, 2017

(54) RETAIL PRODUCT DISPLAY UNIT HAVING GRAVITY OPERATED FRONT BARRIER FOR PRODUCT LOADING

(71) Applicant: Bruegmann USA, Inc., Houston, TX (US)

(72) Inventor: Malte Bruegmann, Houston, TX (US)

(73) Assignee: Bruegmann USA, Inc., Houston, TX (US)

( * ) Notice: Subject to any disclaimer, the term of this patent is extended or adjusted under 35 U.S.C. 154(b) by 0 days.

(21) Appl. No.: 15/013,311

(22) Filed: Feb. 2, 2016

(51) Int. Cl.

| | |
|---|---|
| ***A47F 7/00*** | (2006.01) |
| ***A47F 1/04*** | (2006.01) |
| ***A47G 29/087*** | (2006.01) |
| ***A47F 1/12*** | (2006.01) |
| ***A47F 5/00*** | (2006.01) |
| ***A47F 5/10*** | (2006.01) |

(52) U.S. Cl.
CPC ..... *A47F 1/126* (2013.01); *A47F 5/005* (2013.01); *A47F 5/10* (2013.01)

(58) Field of Classification Search
CPC .. A47F 1/125; A47F 1/126; A47F 5/10; A47F 5/005; A47F 7/28; A47F 1/04; A47F 3/02; A47F 5/0068; A47F 3/002; A47F 5/16; A47B 73/00; B65G 1/026; B65G 1/023; G07F 11/20; G07F 11/22
USPC ..... 211/59.3, 59.2, 161, 152, 119.003, 184; 312/35, 61, 71; 221/227, 255, 257, 279, 221/226, 229, 56, 59, 92, 247, 269, 270, 221/271
See application file for complete search history.

(56) References Cited

U.S. PATENT DOCUMENTS

| | | | | | |
|---|---|---|---|---|---|
| 3,110,402 | A * | 11/1963 | Mogulescu | A47F 1/126 | 211/59.3 |
| 4,901,869 | A * | 2/1990 | Hawkinson | A47F 1/126 | 211/184 |
| 4,930,663 | A * | 6/1990 | Ficken | G07F 11/42 | 221/242 |
| 5,265,738 | A * | 11/1993 | Yablans | A47F 1/126 | 211/184 |
| 5,562,217 | A * | 10/1996 | Salveson | A47F 1/126 | 211/175 |
| 5,570,811 | A * | 11/1996 | Wittern, Jr. | G07F 11/42 | 221/127 |
| 5,634,564 | A * | 6/1997 | Spamer | A47F 1/126 | 211/175 |
| 5,873,489 | A * | 2/1999 | Ide | G07F 11/42 | 211/59.3 |
| 6,142,317 | A * | 11/2000 | Merl | A47F 1/126 | 211/184 |

(Continued)

*Primary Examiner* — Jennifer E Novosad
(74) *Attorney, Agent, or Firm* — Richard A. Fagin

(57) ABSTRACT

A product display unit includes a base having a forward end cap at one longitudinal end. At least one pusher track extends in a longitudinal direction from the end cap. The pusher track includes a locking feature for retaining a pusher rail therein. The pusher rail has a corresponding locking feature such that the pusher rail is locked into the pusher track by compression of the pusher rail against the pusher track. The display has at least one pusher having a wound spring. The forward end cap has a retaining groove for a retaining tongue at one end of the wound spring. The pusher has inwardly projecting side rails defining a channel for insertion therein of the pusher rail.

30 Claims, 10 Drawing Sheets

(56) References Cited

U.S. PATENT DOCUMENTS 6,227,385 B1 * 5/2001 Nickerson ..... A47F 1/126 108/61
6,622,874 B1 * 9/2003 Hawkinson ..... A47F 1/126 211/175
7,201,281 B1 * 4/2007 Welker ..... A47F 1/126 211/59.3
7,628,282 B2 * 12/2009 Hardy ..... A47F 1/126 211/151
7,686,185 B2 * 3/2010 Zychinski ..... G07F 11/38 211/59.3
7,918,353 B1 * 4/2011 Luberto ..... A47F 1/126 211/59.3
8,038,018 B1 * 10/2011 Breitenbach ..... G07F 11/36 211/59.3
8,096,427 B2 * 1/2012 Hardy ..... A47F 1/126 211/59.3
8,267,258 B2 * 9/2012 Allwright ..... B65H 1/00 211/59.3
8,496,126 B2 * 7/2013 Mueller ..... A47F 1/126 211/59.3
9,016,482 B2 * 4/2015 Kim ..... A47F 1/126 211/59.2
2002/0170866 A1 * 11/2002 Johnson ..... A47F 1/126 211/59.3
2005/0092703 A1 * 5/2005 Mueller ..... A47F 5/005 211/59.3
2005/0189310 A1 * 9/2005 Richter ..... A47F 1/126 211/59.3
2005/0189369 A1 * 9/2005 Vlastakis ..... A47F 1/126 221/123
2005/0218094 A1 * 10/2005 Howerton ..... A47F 1/126 211/59.3
2007/0267366 A1 * 11/2007 Howerton ..... A47F 1/126 211/59.3
2008/0142458 A1 * 6/2008 Medcalf ..... A47F 1/126 211/59.3
2008/0156752 A1 * 7/2008 Bryson ..... A47F 1/126 211/59.3
2009/0084812 A1 * 4/2009 Kirschner ..... A47F 1/126 221/186
2010/0089847 A1 * 4/2010 Rataiczak, III ..... A47F 5/005 211/59.3
2011/0089125 A1 * 4/2011 Roeske ..... A47F 1/126 211/59.2
2012/0048817 A1 * 3/2012 Green ..... A47F 5/0068 211/59.3
2012/0118840 A1 * 5/2012 Howley ..... A47F 1/126 211/59.3
2015/0289683 A1 * 10/2015 Walker ..... A47F 5/005 211/59.3

* cited by examiner

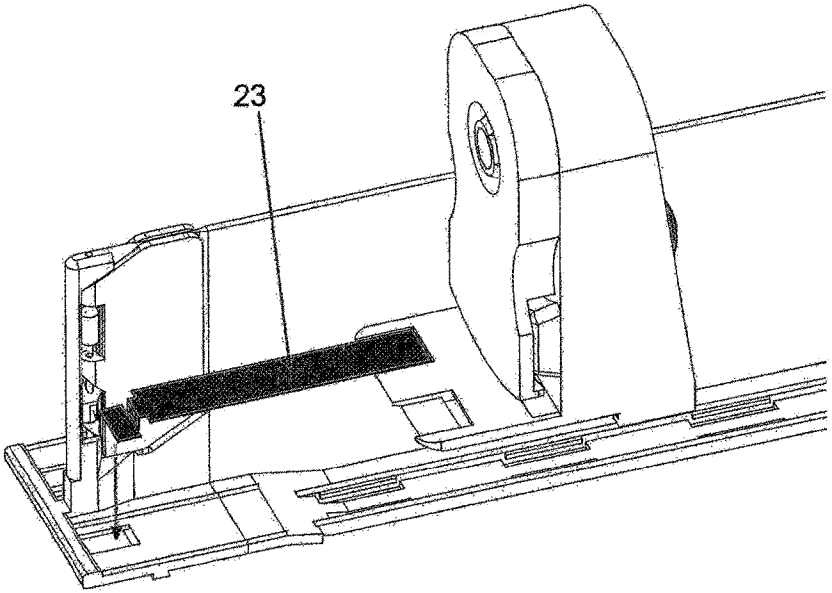
FIG.18
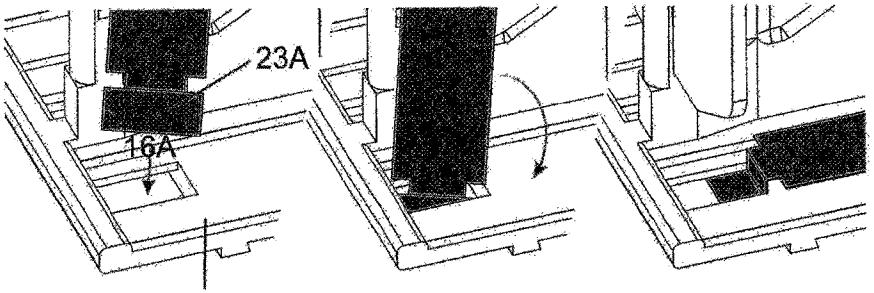
FIG.19
FIG.20
FIG.21
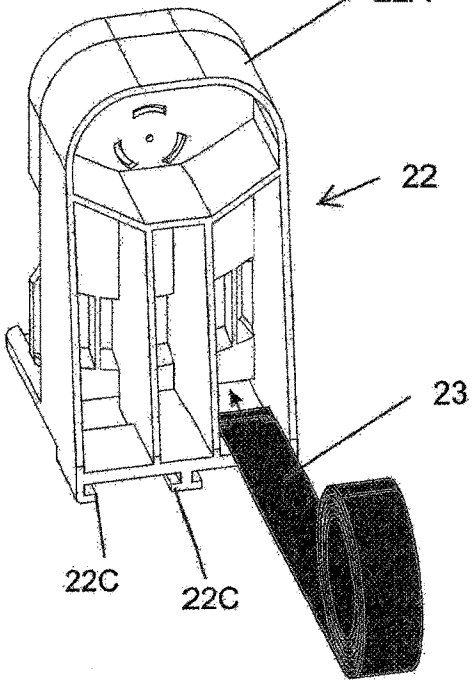
FIG.17

RETAIL PRODUCT DISPLAY UNIT HAVING GRAVITY OPERATED FRONT BARRIER FOR PRODUCT LOADING

CROSS REFERENCE TO RELATED APPLICATIONS

Not Applicable

STATEMENT REGARDING FEDERALLY SPONSORED RESEARCH OR DEVELOPMENT

Not Applicable

NAMES OF THE PARTIES TO A JOINT RESEARCH AGREEMENT

Not Applicable.

BACKGROUND

This disclosure relates to the field of retail product storage and display devices. More specifically, the disclosure relates to retail product displays that may load product containers or packages through a forward end of the display.

Retail product displays known in the art include modular retail product package displays. Such modular displays may be mounted to a shelf, rack or other type of display case such as a refrigerated case individually, and/or side by side and/or vertically separated from each other on a shelf or rack or in a display case. Product packages or containers may be urged toward a forward end of the display by gravity, e.g., using a display floor which is inclined and may have a plurality of rollers disposed in the floor. One example of such a gravity operated display is sold under the trademark FLEXROLLER, which is a registered trademark of Bruegmann, USA, Inc., 589 Garden Oaks Drive, Houston, Tex. 77018. The product packages may be held on the display by a barrier at the forward end of the display floor. As individual product packages are removed from the display, remaining packages are gravitationally urged forward toward the barrier.

Other types of product displays may use a biased plate or "pusher" that contacts the rearwardmost product package disposed on the display such that the rearwardmost package and all packages on the display in a line forward of the rearwardmost package are urged toward the front end of the display. As individual product packages are removed from the display, the pusher urges the remaining packages forward toward the barrier.

In some configurations of the foregoing types of display, additional product packages may be loaded onto the display by loading from above the display. For gravity operated displays, the product packages are simply placed on the display floor. For pusher operated displays, the pusher is moved rearwardly and additional product packages are inserted into open space between the barrier, or the rearwardmost of any remaining packages on the display floor and the pusher. The pusher is then released to resume operation of the display.

Other types of product displays may be replenished with additional product packages by loading additional product packages through the forward end of the display. In such displays the barrier may be movable to enable access to the product "lane." Movable barriers known in the art include spring actuated plate type barriers that may be moved by the user pushing on the barrier such that it rotates about an axis parallel to the front edge of the display, thus opening the product "lane" for insertion of product packages. When the barrier is released, a spring such as a torsion spring rotates the barrier to approximately perpendicular to the plane of the display floor, and further rotation of the barrier is limited such that product packages urged forward by gravity or by a pusher are retained by the barrier. One such product display is sold by Henschel Steinau, Inc., 50 Commerce Drive, Allendale, N.J. 07401.

BRIEF DESCRIPTION OF THE DRAWINGS

FIG. 17 shows assembly of a pusher spring to the pusher housing in one embodiment.

FIGS. 18 through 21 show one embodiment of an end of the pusher spring being assembled to an end cap of the display unit base of FIG. 1.

DETAILED DESCRIPTION

Figures 1, 2, 3, 4, 5:
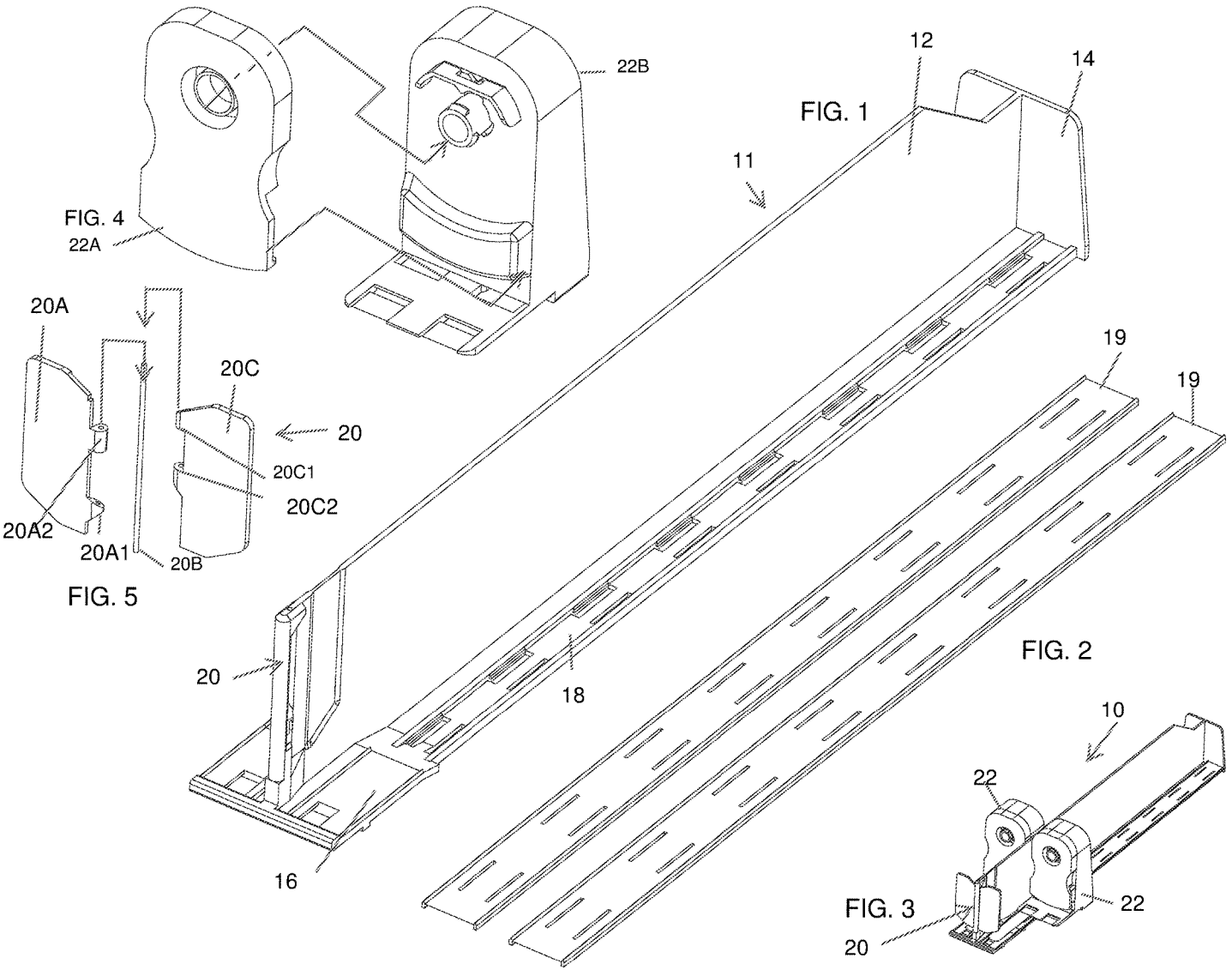
FIG. 1 shows a product display unit base with a gravity operated front barrier according to the present disclosure.
FIG. 2 shows pusher mounting rails that may be used in some embodiments of a product display unit.
FIG. 3 shows an example embodiment of an assembled product display unit having two product container "lanes" each with a pusher to urge product containers toward a barrier at the forward end of the display unit.
FIG. 4 shows parts of an example embodiment of a pusher that may be used in some embodiments of a product display unit in accordance with the present disclosure.
FIG. 5 shows an exploded view of an example embodiment of a gravity operated front barrier.

FIG. 1 shows an oblique view of one example embodiment of a product display unit base 11 according to the present disclosure. The product display unit base 11 may comprise at least one pusher rail mounting track 18 extending from a forward end cap 16 to a rear barrier 14. A product lane divider 12 may be coupled to the product display unit base 11 and oriented in a plane substantially perpendicular to the plane of the pusher rail mounting track 18. In the present embodiment, a second pusher rail mounting track 18 may be disposed on an opposite side of the product lane divider 12. In other embodiments, the second pusher rail 18 track may be omitted. A gravity operated front barrier 20 may be mounted along a line substantially perpendicular to the plane of the pusher rail mounting track and parallel to the divider 12. The front barrier 20 may include one or two gravity operated front barrier doors to be explained further with reference to FIG. 5. The product display unit base 11, excluding the front barrier 20 may be formed as a single piece, for example, by injection molding of a suitable plastic such as high-impact ABS (acrylonitrile butadirene styrene) plastic or any other plastic having suitable mechanical properties.

FIG. 2 shows examples of pusher rails 19 that may be clip mounted into respective pusher tracks (18 in FIG. 1) to mount a respective pusher (22 in FIG. 3) to the product display base 11. The pusher rails 19 will be further explained in more detail with reference to FIGS. 22-24 and may be made from metal such as aluminum or from molded plastic or any other material having suitable mechanical properties.

FIG. 3 shows an oblique view of an example embodiment of an assembled product display 10, including two pushers 22 and a two-plate front barrier 20 assembled to the display unit base (11 in FIG. 1).

FIG. 4 shows an exploded view of one example embodiment of an adjustable area face pusher (22 in FIG. 3) according to the present disclosure. The pusher (22 in FIG. 3) may comprise a rotatable paddle 22A having a product contacting face and a pusher housing 22B to which the rotatable paddle 22A may be assembled. The present example embodiment of the pusher will be explained in more detail with reference to FIGS. 10 through 16.

FIG. 5 shows an exploded view of one example embodiment of a gravity operated front barrier according to the present disclosure. The front barrier 20 may comprise at least one (a first) gravity operated barrier door 20C that may be rotatably coupled to the display unit base (11 in FIG. 1) using a hinge pin 20B. In the present embodiment, the front barrier may comprise a second gravity operated barrier door 20A which may be rotatably mounted to the product display unit base (11 in FIG. 1) using the same hinge pin 20B. The first barrier door 20C may comprise a beveled hinge 20C1 that cooperatively contacts a hinge 20A2 on a second barrier door 20A such that when the first barrier door 20C is rotated so that the plane of the first barrier door 20C is moved in the direction of the plane of the divider (12 in FIG. 1), the first barrier door 20C is lifted along the axis of the hinge pin 20B. In this way, gravity will cause the first barrier door 20C to rotate to the closed position as shown in FIG. 1. The second barrier door 20A may include a corresponding beveled hinge 20A1 that cooperatively engages the hinge 20C2 on the first barrier door 20C to provide the same gravity closing function as for the first barrier door 20C. In some embodiments, only the first barrier door 20C may be used. In such embodiments, features (not shown) may be provided on the hinge pin 20B corresponding to the hinge 20A2 on the second barrier door to cooperatively engage the beveled hinge 20C1 to provide gravity operate closure of the first barrier door 20C.

In some embodiments, the first 20C and/or second 20A barrier doors may be weighted such as by molding the door(s) to have a suitable shape and/or molding in weights in the barrier door material such that when the barrier door(s) are hingedly coupled to a product display based that is tilted toward the barrier door(s), gravity will urge the barrier door(s) to close even if the beveled hinge (e.g., 20C1, 20A1) is not included.

Figure 7:
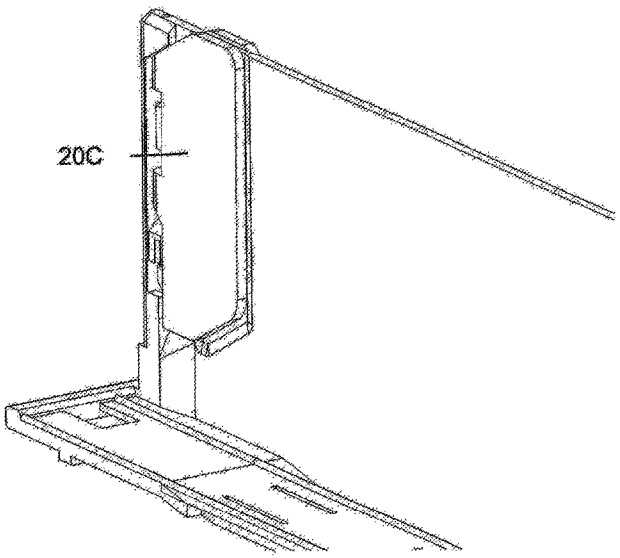
FIG. 7 shows a detailed view of the front barrier when opened to insert product containers into the example embodiment of the product display unit.
Figure 6:
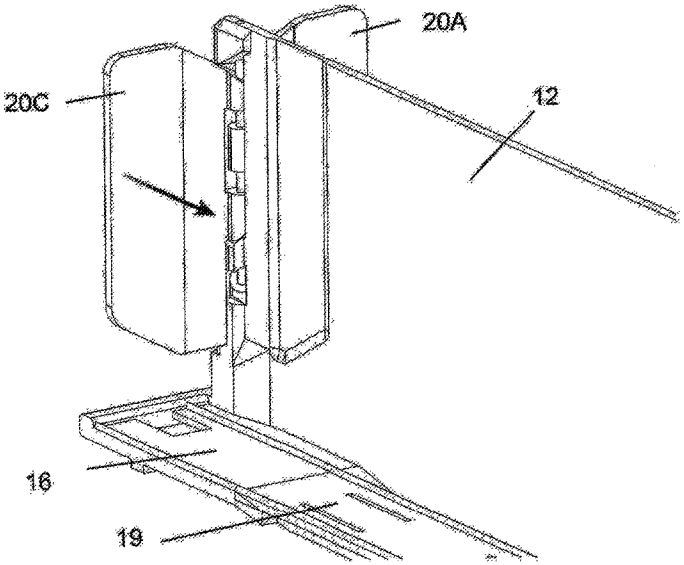
FIG. 6 shows an oblique detailed view of a double-sided gravity operated front barrier in accordance with the present disclosure.

FIG. 6 shows an oblique detailed view of a double-sided gravity operated front barrier (20 in FIG. 1) in accordance with the present disclosure. In FIG. 6, the first barrier door 20C and the second barrier door 20A are shown in the closed position such that product containers urged forward by the respective pusher (FIG. 3) are prevented from being moved forward beyond the respective barrier door, 20A, 20C. FIG. 6 also shows the divider 12 and one of the pusher rails 19 as well as the forward end cap 16. FIG. 7 shows a similar view to FIG. 6 wherein the barrier doors 20C (and 20A in FIG. 6) are in the open position. To open the barrier doors 20A, 20C in the present example embodiment, it is only necessary to urge a product container through the respective barrier door 20A, 20C toward the back of the product display base (11 in FIG. 1). Once the product container(s) have been moved beyond the end of the respective barrier door when in the open position, gravity will urge the respective barrier door to rotate to the closed position (FIG. 6) thereby retaining product containers in a "lane" created by the product display base (11 in FIG. 1) and the divider 12. Individual product containers may be removed from the "lane" by lifting over the respective barrier door (20A, 20C).

Figure 7A:
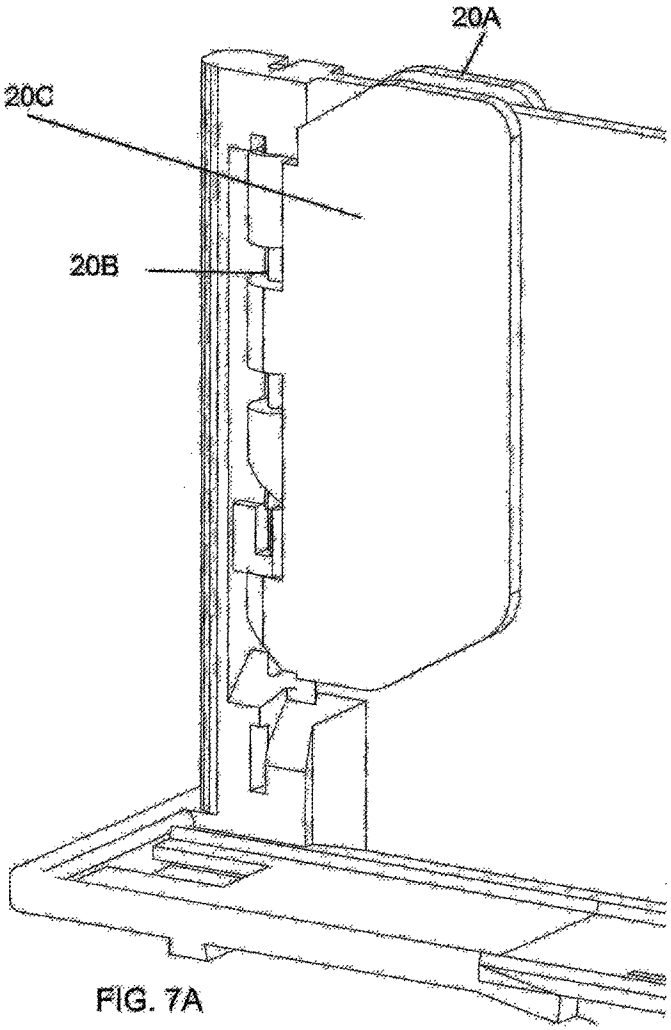
FIGS. 6A and 7A show a detained view of another embodiment of the front barrier of FIGS. 6 and 7 including an assist spring.
Figure 6A:
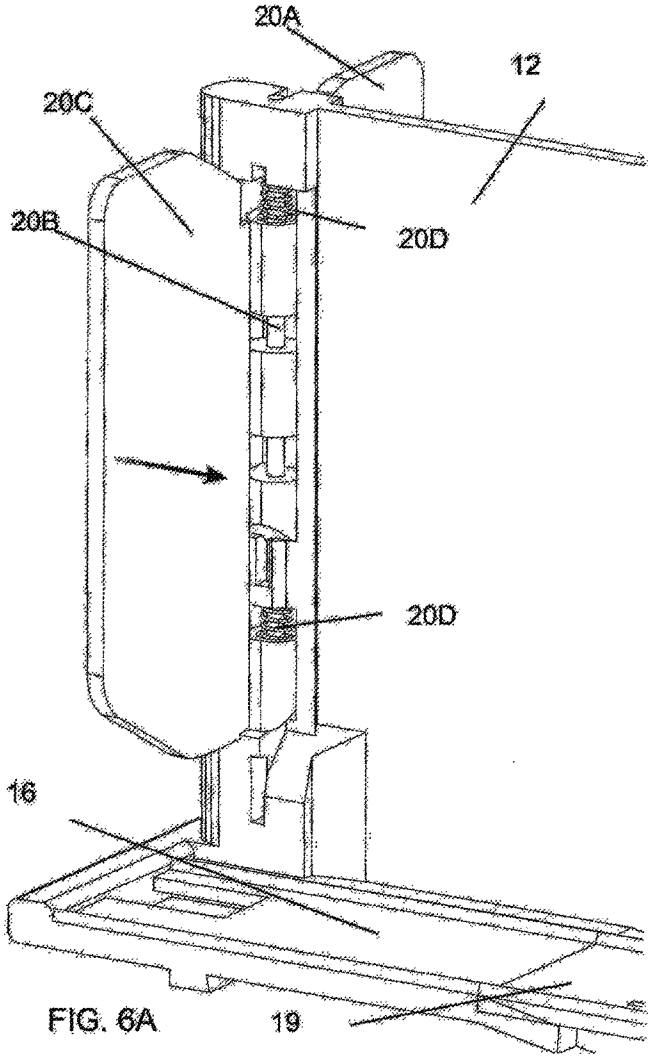

In some embodiments, and referring to FIGS. 6A and 7A, the front barrier doors 20A, 20C may be assisted in returning to the closed position (FIG. 6A) using one or more springs 20D that cooperate with the bevelled hinge (20A1, 20C1 in FIG. 5) to urge the barrier door hinges downward, thereby urging the front barrier doors 20A, 20C to the closed position. When the barrier doors are opened (FIG. 7A) the springs (20D in FIG. 6A) will be compressed to exert an additional force cooperating with the bevelled hinges to urge the barrier doors closed.

Figure 9:
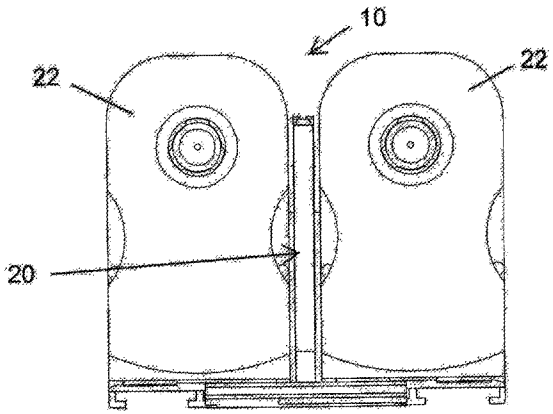
FIG. 9 shows a front elevational view of the product display unit with the barrier opened to insert additional product containers.
Figure 8:
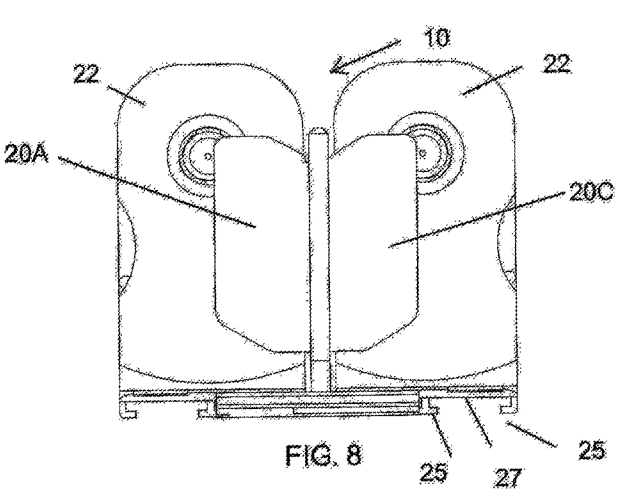
FIG. 8 shows a front elevation view of the example embodiment (FIG. 1) of the assembled product display unit with the gravity operated barrier in the closed position.

FIG. 8 shows a front elevational view of the product display unit 10 with the barrier doors 20A, 20C in the closed position. The respective pushers 22 may also be observed in FIG. 8. FIG. 9 shows a front elevational view of the product display unit 10 with the product barrier 20 doors (20A, 20C in FIG. 8) in the open position for insertion of product containers (not shown). In the present example embodiment, a channel 27 through which the pusher rail (19 in FIG. 2) may be inserted may be formed by two opposed, inwardly projecting side rails 25. The purpose for the channel 27 will be explained further with reference to FIGS. 22-24.

Figure 12:
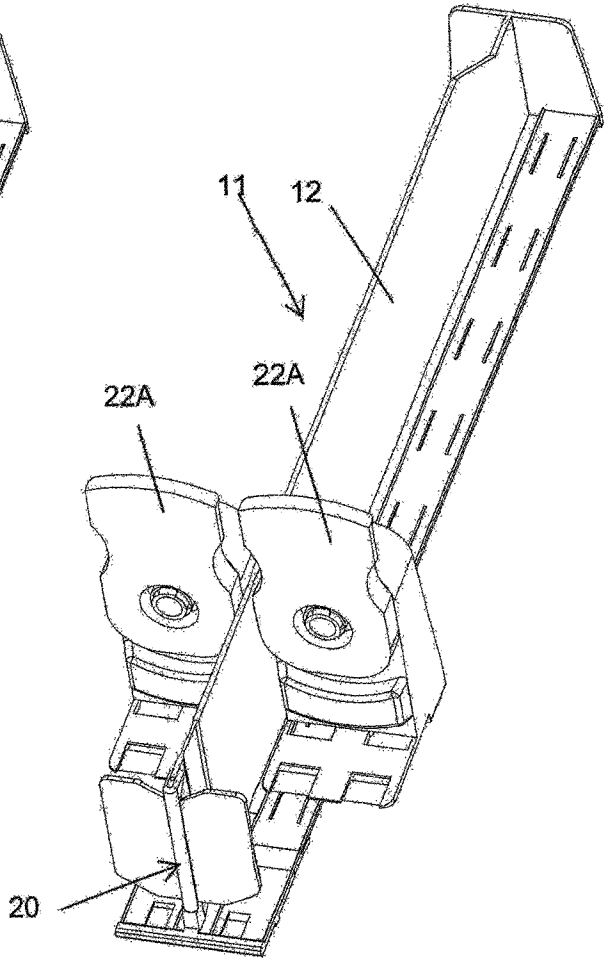
FIG. 12 shows the view of FIG. 10 wherein the rotatable paddles are rotated to a vertically outwardmost position for tall product packages.
Figure 11:
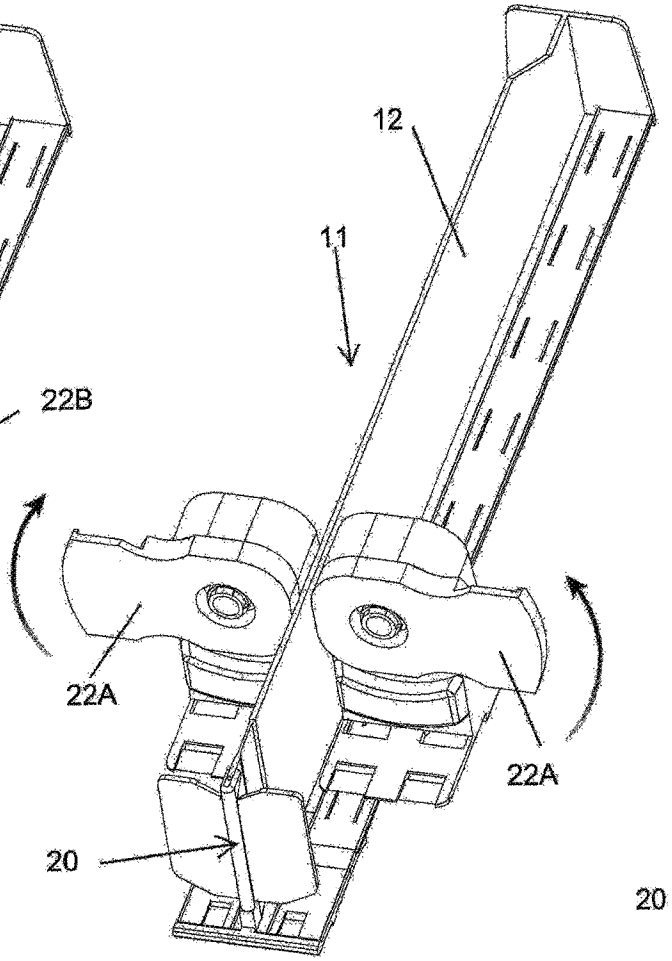
FIG. 11 shows the view of FIG. 10 wherein rotatable paddles on the pushers are rotated to a lateral outwardmost position for wide product packages.
Figure 10:
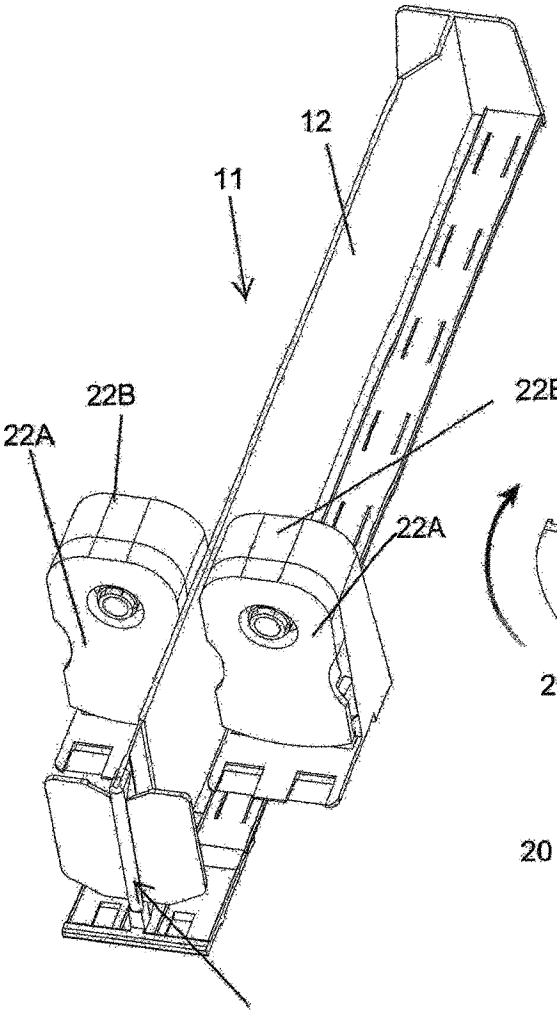
FIG. 10 shows an oblique view of the example embodiment of a product display unit wherein adjustable pushers are in minimum area orientation.

FIGS. 10 through 12 show oblique views of the product display unit 10 to illustrate how the pushers 22 may be operate to change their surface area to accommodate different size product containers. In FIG. 12, the rotatable paddle 22A on each pusher 22 is in a closed position relative to the pusher housing 22B to minimize the surface area of the pusher 22 for smaller product containers. In FIG. 11, the rotatable paddles 22A are oriented in a horizontal plane to maximize the width of the surface area of the pushers 22 to accommodate wide product packages. In FIG. 12, the rotatable paddles 22A are oriented opposite to the closed position of FIG. 10 to accommodate tall product packages. As will be further explained with reference to FIGS. 13-16, the rotatable paddles 22A may also be oriented in directions other than the ones shown in FIGS. 10-12 for different types of product packages.

Figure 13:
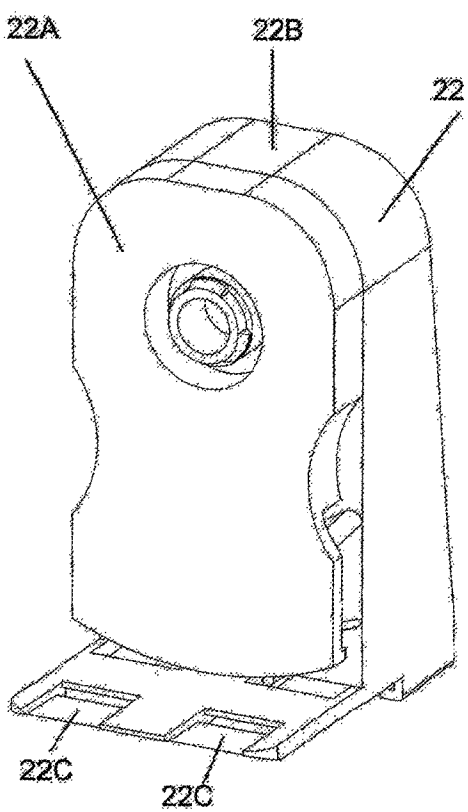
FIG. 13 shows an oblique view of an assembled example embodiment of a pusher as shown in FIGS. 10 through 12.

FIG. 13 shows a front oblique view of an example embodiment of a pusher 22. The pusher 22 may be formed from two separate components, i.e., the rotatable paddle 22A and the pusher housing 22B. A bottom of the pusher housing 22B may include at least one and in the present embodiment two spring slots 22C from which a spring (FIG. 17) may extend to provide a biasing force to urge the pusher 22 toward the front barrier (20 in FIG. 1).

Figure 14:
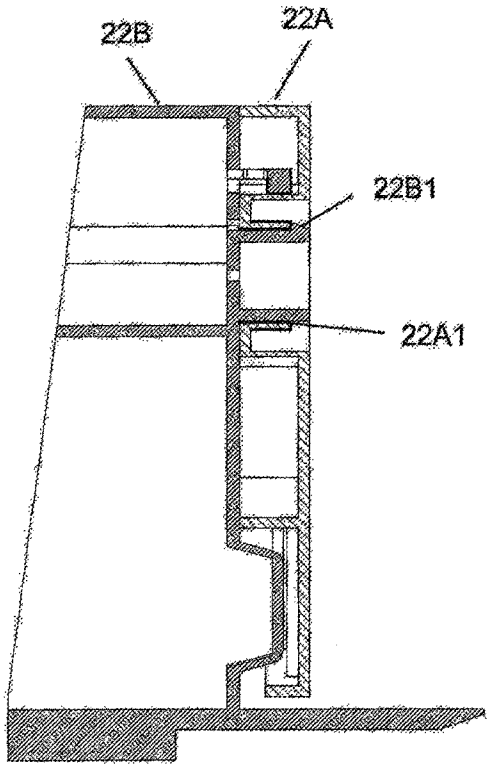
FIG. 14 shows a side elevation cross-section of the example embodiment of the pusher shown in FIG. 13.

FIG. 14 shows a side cross-sectional view of the pusher shown in FIG. 13. The pusher housing 22B may include locking tabs 22B1 arranged in a circular pattern (see FIG. 16) to retain the rotatable paddle 22A to the pusher housing 22B. The rotatable paddle 22A may include a circular opening 22A1 to engage the locking tabs 22B1 and enable rotation of the paddle 22A about the axis of the locking tabs 22B 1.

Figure 15:
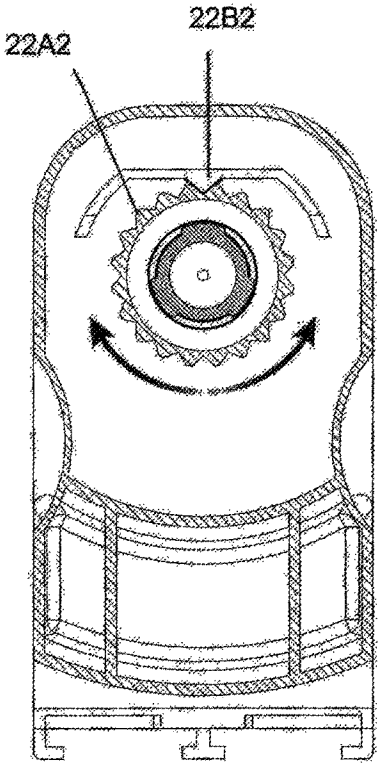
FIG. 15 shows a front cut away view of the pusher of FIG. 13 illustrating a detent pin and a toothed wheel to retain rotatable the pusher paddle in selected rotational orientations.

FIG. 15 shows an example embodiment of the rotatable paddle 22 having therein a toothed wheel 22A2, which may be formed as a single unit with the rotatable paddle 22A if the paddle is so made. The toothed wheel 22A2 engages a detent pin 22B2 that may be formed as a unit with the pusher housing 22 when the pusher housing is formed. The detent pin 22B2 (as well as the pusher housing 22) may be made from a material that is suitable resilient such that the toothed wheel 22A2 is retained in a selected rotational orientation by the detent pin 22B2, while enabling rotation of the paddle (22A in FIG. 13) using only hand pressure.

Figure 16:
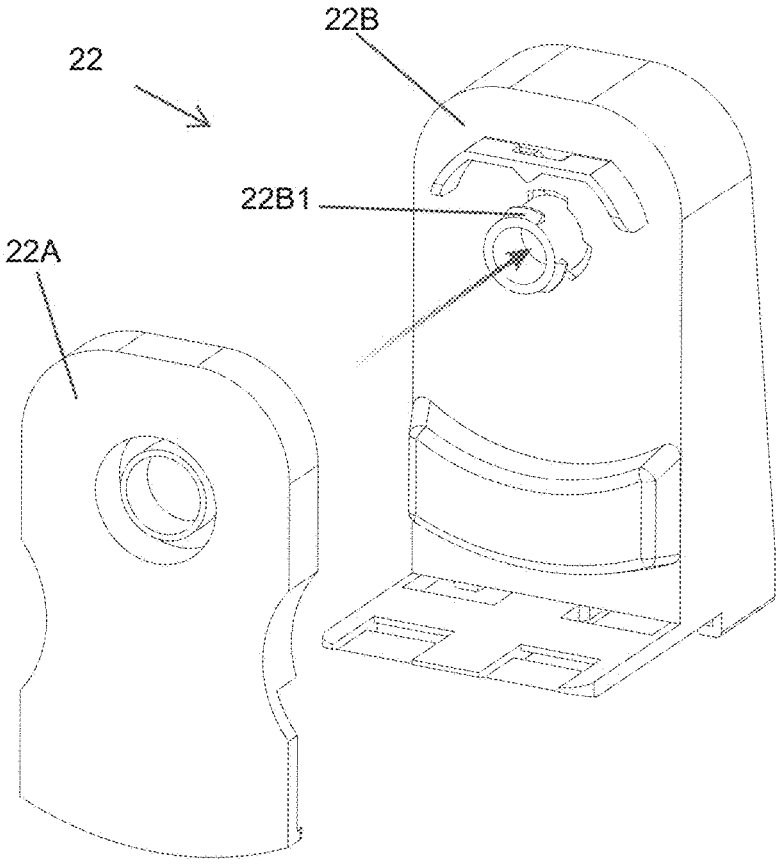
FIG. 16 shows a detailed view of an example embodiment of a pusher paddle and pusher housing according to the present disclosure.

FIG. 16 shows an oblique exploded view of the pusher housing 22B and the rotatable paddle 22A wherein the locking tabs 22B1 are more clearly visible. The pusher 22 may be assembled by pushing the paddle 22A onto the locking tabs 22B1 thus locking the paddle 22A to the pusher housing 22B.

FIG. 17 shows a rear view of the pusher 22 wherein an open space in the back of the pusher housing 22 encloses a flat coiled spring 23. An end of the spring 23 may extend through one of the slots (22C in FIG. 13) such that when the pusher 22 is urged toward the back (14 in FIG. 1) of the product display base (11 in FIG. 1) the coil spring 23 is unwound and thereby is biased toward the front of the display base (11 in FIG. 1).

FIGS. 18-21 show one embodiment of a connection between the end of the spring 23 and the end cap 16 of the product display base (11 in FIG. 1). The spring 23 may include a notched tongue 23A on its end that may engage a slot 16A in the end cap 16 by rotating the pusher (22 in FIG. 17) such that the small dimension of the grooved tongue 23A is enabled to fit through the slot 16A. In FIG. 21, the pusher is rotated back to its position for assembly to the product display base (11 in FIG. 1) thus locking the tongue 23A in the slot 16A.

Figure 22:
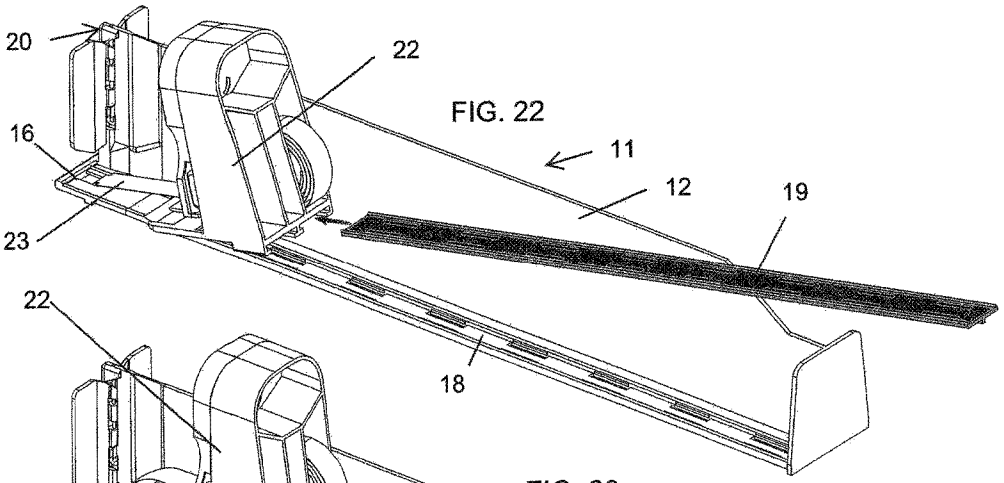
FIGS. 22-24 show assembly of a pusher rail to the example embodiment of the display unit base.
Figure 23:
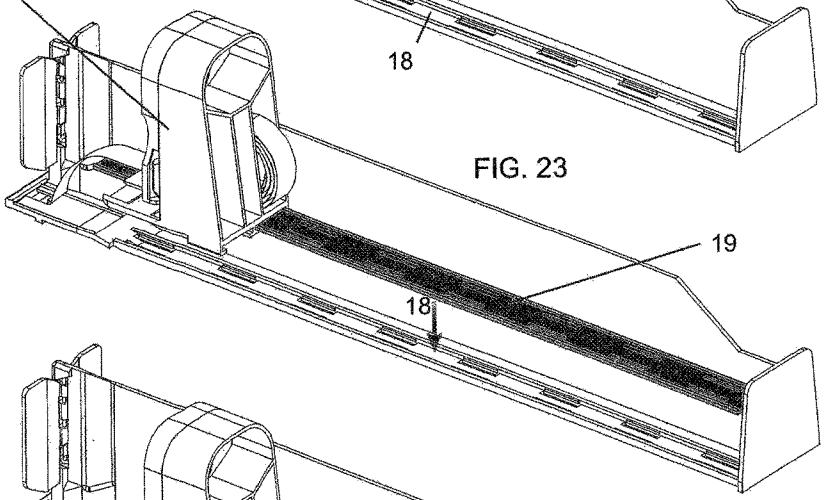
Figure 24:
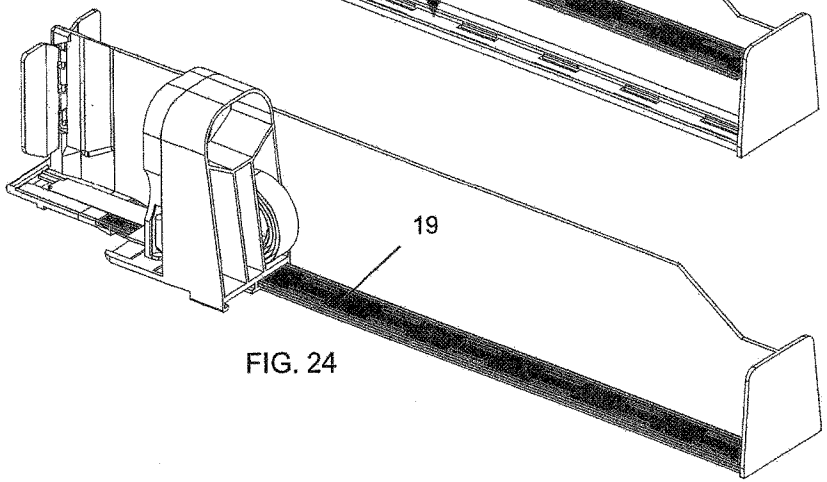

FIGS. 22-24 show assembly of the pusher rail 19 to the pusher 22 and subsequent mounting of the pusher rail 19 to the pusher track 18. In FIG. 22, the spring 23 is assembled to the end cap 16, for example, as explained with reference to FIGS. 18-21. The pusher rail 19 may then be inserted through the channel (27 in FIG. 8) formed by the inwardly projecting side rails (25 in FIG. 8). In FIG. 23, the pusher rail 23 with the pusher 22 mounted thereon as explained above may be lowered onto the pusher track 18. In FIG. 24, the pusher rail 19 may be assembled to the pusher track 18.

Figure 25:
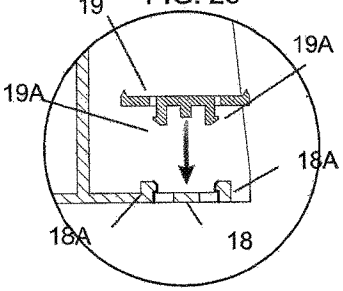
FIGS. 25 and 26 show cross-sectional views of features of the pusher rail and display unit base enabling locking assembly of the pusher rail to the display unit base.
Figure 26:
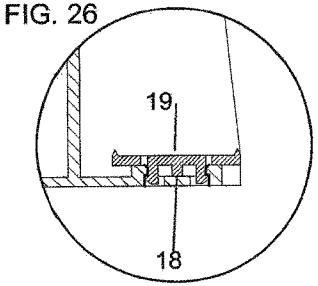

In the present example embodiment, the pusher rail 19, which in the embodiment as clearly shown in FIGS. 22, 23 and 24 may be substantially the same length as the pusher track 18 and may be snap fit and locked into place on the pusher track 18 by having suitably formed features on the bottom of the pusher rail 19 and on the pusher track 18. Such features may be observed in FIGS. 25 and 26. In FIG. 25, the bottom of the pusher rail 19 may comprise two, opposed, outwardly projecting snap fit locking strips 19A that may be formed into the bottom of the pusher rail 19. The snap fit locking strips 19A may extend for any portion(s) of or all of the length of the pusher rail 19. If, for example, the pusher rail 19 is made by extrusion, e.g., extruded aluminum, the cross-sectional shape shown in FIG. 25 of the pusher rail 19 may be the shape used for the extruder die. In other embodiments, the pusher rail 19 may be made from plastic such as thermoplastic and the shape shown in cross section in FIG. 25 may be used for a mold. In the present example embodiment, the pusher track 18 may have two opposed, inwardly projecting snap fit lock strips 18A that cooperatively engage the snap fit locking strips 19A on the pusher rail 19. Thus, the pusher rail 19 may be assembled by pressing the pusher rail 19 into the pusher track 18 such that the corresponding locking strips 19A, 18A engage each other to lock the pusher rail 19 onto the pusher track 19. An assembled cross sectional view of the pusher rail 19 and the pusher track 18 are shown in FIG. 26.

Figure 27:
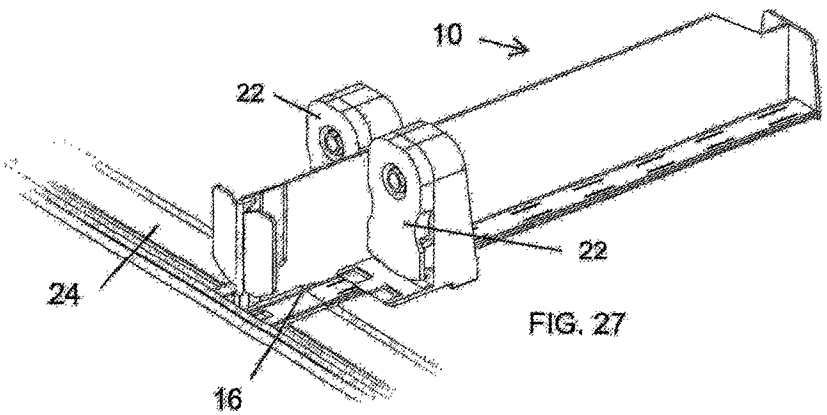
FIGS. 27-29 show assembly of the display unit to a front rail.

In some embodiments, the product display unit 10 may be assembled to a front rail that enables lateral movement of the product display unit 10 to accommodate additional product displays of varying widths and configurations. FIG. 27 shows an example embodiment of the product display unit 10 assembled to a front rail 24, wherein the end cap 16 comprises features (FIGS. 28 and 29) to hold the product display unit 10 onto the front rail 24 while allowing lateral movement along the front rail 24 of the product display unit 10 transversely to the length of the product display unit 10.

Figure 28:
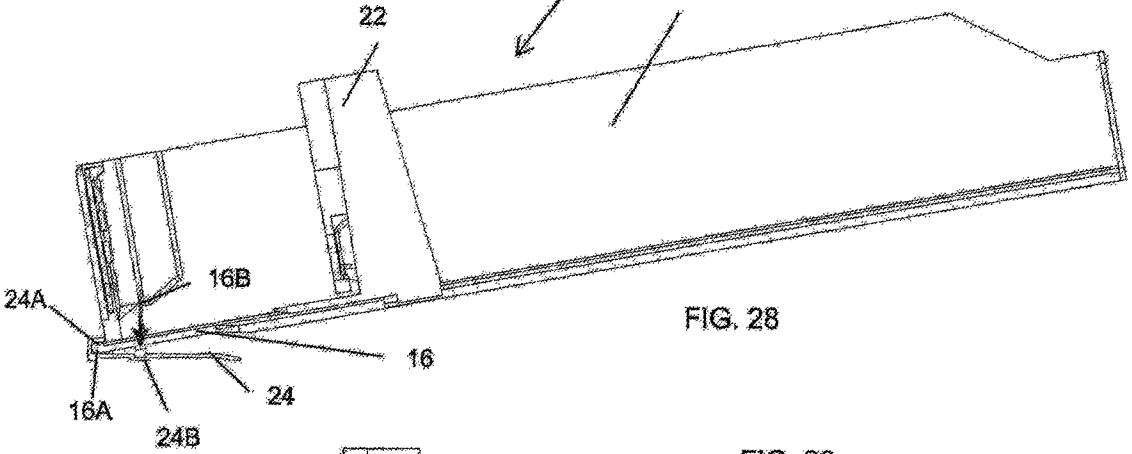
Figure 29:
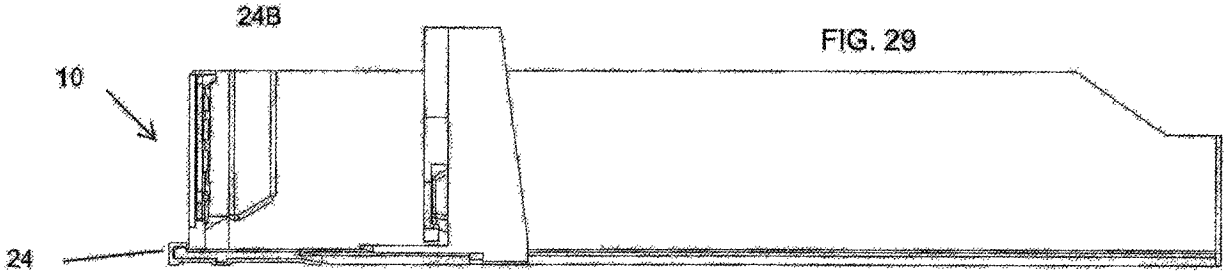

In FIG. 28, the end cap 16 may comprise an upwardly projecting retaining strip 16A that fits in a corresponding groove 24A formed in the front of the front rail 24. A downwardly projecting retaining strip 16B may be formed in the bottom of the end cap 16 at a selected distance along the length of the end cap and in a direction transverse to the length of the product display unit 10. FIG. 28 shows the upwardly projecting retaining strip 16A being inserted into the corresponding groove 24A by lifting the back end of the product display unit 10. The downwardly projecting retaining strip 16B may be engaged with the corresponding groove 24B by lowering the back end of the product display unit 10 into its assembled position (FIG. 29) which may be on a surface of a display case or other form of final assembly. In some embodiments, the front rail 24 may include a feature (not shown) for mounting a front barrier (not shown) which may extend for any part(s) of or all of the length of the front rail 24.

Figure 30:
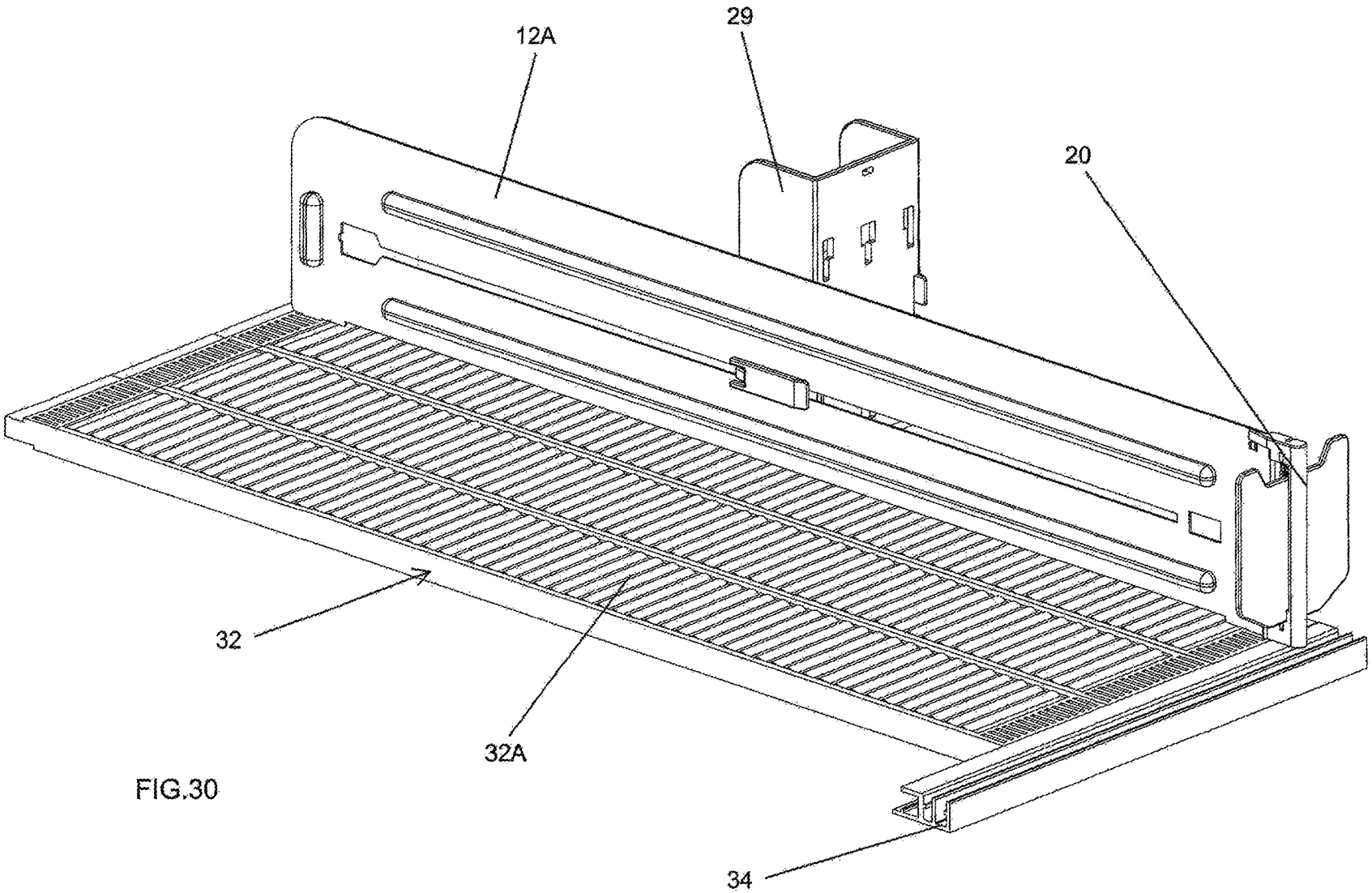
FIG. 30 shows another embodiment of a product display unit that uses a front barrier as in the embodiments explained with reference to FIGS. 1 through 7.

FIG. 30 shows another example embodiment of a product display unit comprising a gravity operated front barrier or door as explained with reference to FIGS. 1 through 7. In FIG. 30, a product display "lane" may comprise a roller track 32 having a plurality of rollers 32A arranged threreon and coupled at its forward end to a front rail 34. Such product display lane may be similar in configuration to one sold under the trademark FLEXROLLER, which is a registered trademark of Bruegmann USA, Inc. A lane divider 12A may be coupled to the front rail 34, for example, in the same manner as used in the FLEXROLLER product display unit. A rear lane barrier 29 may be affixed at a selected position along the length of the lane divider 12A such that a depth of the product lane is limited to a selected amount. The roller track 32 may be mounted so that it is inclined toward the front rail 34, again consistent with the ordinary mounting of the roller track used with the FLEXROLLER product display unit. A gravity operated door or barrier 20 may be affixed to the front rail 34 and may comprise features such that the door or barrier 20 is self-closing after insertion of product packages through the door or barrier 20. The FLEXROLLER roller track 32 when mounted in a forward-inclined orientation may enable product packaging to move forward toward the door or barrier 20 and be retained in place for removal individually by a purchaser or user.

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

What is claimed is:

1. A product display unit, comprising:

a product display unit base comprising a forward end cap at one longitudinal end thereof;

at least one pusher track extending in a longitudinal direction from the forward end cap, the pusher track comprising a locking feature for retaining a pusher rail therein, the pusher rail comprising a corresponding locking feature such that the pusher rail is locked into the at least one pusher track by compression of the pusher rail against the at least one pusher track, the pusher rail being substantially a same length as the pusher track, the pusher rail extending from the forward end cap and disposed on top of the pusher track; and at least one pusher comprising a wound spring, the forward end cap comprising a retaining groove for a retaining tongue at one end of the wound spring, the at least one pusher comprising inwardly projecting side rails on a bottom thereof defining a channel for insertion therein of the pusher rail.

2. The product display unit of claim 1 further comprising at least one product lane divider extending in a direction parallel to the at least one pusher track and in a plane substantially normal to a plane of the at least one pusher track.

3. The product display unit of claim 2 wherein the at least one product lane divider, the at least one pusher track and the forward end cap are formed as a unit.

4. The product display unit of claim 1 further comprising a rear barrier at a second longitudinal end of the at least one pusher track opposite to the forward end cap.

5. The product display unit of claim 4 wherein the at least one pusher track, the forward end cap and the rear barrier are formed as a unit.

6. The product display unit of claim 1 wherein the at least one pusher comprises an adjustable area pusher face.

7. The product display unit of claim 6 wherein the adjustable area pusher face comprises a rotatable paddle mounted to a pusher housing.

8. The product display unit of claim 7 wherein the pusher housing comprises locking tabs arranged in a circular pattern and extended through an opening in the rotatable paddle when the rotatable paddle is assembled to the pusher housing.

9. The product display unit of claim 7 wherein one of the rotatable paddle or the pusher housing comprises a toothed wheel and the other of the pusher housing and the rotatable paddle comprises a detent pin such that the rotatable paddle is locked in a selected rotational orientation with respect to the pusher housing.

10. The product display unit of claim 1 further comprising at least one gravity operated barrier disposed proximate the forward end cap, the at least one gravity operated barrier rotatable along an axis substantially perpendicular to a plane of the at least one pusher track in a direction away from the forward end cap whereby product containers are insertable through the gravity operated barrier by longitudinal movement against the at least one gravity operated barrier.

11. The product display unit of claim 10 further comprising at least one spring cooperatively engaged with a beveled hinge on the at least one gravity operated barrier to urge the at least one gravity operated barrier downwardly.

12. The product display unit of claim 10 wherein the at least one gravity operated barrier comprises a beveled hinge disposed on a hinge pin, the beveled hinge cooperatively contacting a second hinge on a product lane divider disposed on the hinge pin, or on a hinge on a second gravity operated barrier disposed on the hinge pin such that rotating the at least one gravity operated barrier lifts the at least one gravity operated barrier vertically away from a plane of the at least one pusher track.

13. The product display unit of claim 1 wherein the forward end cap comprises mounting features to secure the forward end cap to a front rail extending in a direction transverse to a length of the at least one pusher track.

14. The product display of claim 13 wherein the mounting features on the forward end cap comprise an upwardly projecting retaining strip at a forward end of the forward end cap and a downwardly projecting retaining strip longitudinally behind the upwardly projecting retaining strip, the upwardly and downwardly projecting retaining strips configured to engage corresponding features in the front rail such that the product display unit is retained on the front rail movably in a direction along a length of the front rail.

15. A product display unit, comprising:

a product display unit base comprising a forward end cap at one longitudinal end thereof;

means for urging product containers longitudinally along a product lane of the product display unit base toward the forward end cap; and at least one gravity operated barrier disposed proximate the forward end cap, the at least one gravity operated barrier disposed on a hinge positioned at a forward longitudinal end of a product lane divider which extends upwardly from the base and extends rearwardly from the forward end cap, the gravity operated barrier rotatable along an axis substantially perpendicular to a plane of the product display unit base only in a direction away from the forward end cap whereby product containers are insertable through the gravity operated barrier by longitudinal movement against the at least one gravity operated barrier, the at least one gravity operated barrier rotatable by gravity to a closed position after insertion of product containers whereby the product containers are retained in the product lane by the at least one gravity operated barrier.

16. The product display unit of claim 15 wherein the at least one gravity operated barrier comprises a beveled hinge disposed on a hinge pin, the beveled hinge cooperatively contacting the hinge, or on a hinge on a second gravity operated barrier disposed on the hinge pin such that rotating the at least one gravity operated barrier lifts the at least one gravity operated barrier vertically away from a plane of the base.

17. The product display unit of claim 16 further comprising at least one spring cooperatively engaged with the beveled hinge to urge the at least one gravity operated barrier downwardly.

18. The product display unit of claim 15 wherein the at least one product lane divider, the base and the forward end cap are formed as a unit.

19. The product display unit of claim 15 further comprising a rear barrier at a longitudinal end of the base opposite to the forward end cap.

20. The product display unit of claim 19 wherein the at least one pusher track, the forward end cap and the rear barrier are formed as a unit.

21. The product display unit of claim 15 wherein the means for urging comprises at least one pusher track extending in a longitudinal direction from the end cap; and at least one pusher comprising a wound spring operably engaged with the at least one pusher track, the forward end cap comprising a retaining groove for a retaining tongue at one end of the wound spring.

22. The product display unit of claim 21 further comprising a pusher rail engageable with the at least one pusher track, the pusher track comprising a locking feature for retaining the pusher rail therein, the pusher rail comprising a corresponding locking feature such that the pusher rail is locked into the at least one pusher track by compression of the pusher rail against the at least one pusher track.

23. The product display unit of claim 22 wherein the at least one pusher comprises inwardly projecting side rails on a bottom thereof defining a channel for insertion therein of the pusher rail.

24. The product display unit of claim 22 wherein the at least one pusher comprises an adjustable area pusher face.

25. The product display unit of claim 24 wherein the adjustable area pusher face comprises a rotatable paddle mounted to a pusher housing.

26. The product display unit of claim 25 wherein the pusher housing comprises locking table arranged in a circular pattern and extended through an opening in the rotatable paddle when the rotatable paddle is assembled to the pusher housing.

27. The product display unit of claim 25 wherein one of the rotatable paddle or the pusher housing comprises a toothed wheel and the other of the pusher housing and the rotatable paddle comprises a detent pin such that the rotatable paddle is locked in a selected rotational orientation with respect to the pusher housing.

28. The product display unit of claim 15 wherein the forward end cap comprises mounting features to secure the forward end cap to a front rail extending in a direction transverse to a length of the base.

29. The product display unit of claim 28 wherein the mounting features on the forward end cap comprise an upwardly projecting retaining strip at a forward end of the forward end cap and a downwardly projecting retaining strip longitudinally behind the upwardly projecting retaining strip, the upwardly and downwardly projecting retaining strips configured to engage corresponding features in the front rail such that the product display unit is retained on the front rail movably in a direction along a length of the front rail.

30. The product display unit of claim 15 wherein the means for urging comprises a roller track having a plurality of rollers thereon, the roller track oriented at an incline such that gravity urges the product containers toward the gravity operated barrier.

* * * * *